US011629897B2

(12) United States Patent
Higashiiue et al.

(10) Patent No.: US 11,629,897 B2
(45) Date of Patent: Apr. 18, 2023

(54) DISTRIBUTOR, HEAT EXCHANGER, AND REFRIGERATION CYCLE APPARATUS

(71) Applicant: Mitsubishi Electric Corporation, Tokyo (JP)

(72) Inventors: Shinya Higashiiue, Tokyo (JP); Ryota Akaiwa, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 62 days.

(21) Appl. No.: 16/478,877

(22) PCT Filed: Apr. 14, 2017

(86) PCT No.: PCT/JP2017/015344
§ 371 (c)(1),
(2) Date: Jul. 18, 2019

(87) PCT Pub. No.: WO2018/189892
PCT Pub. Date: Oct. 18, 2018

(65) Prior Publication Data

US 2020/0025427 A1 Jan. 23, 2020

(51) Int. Cl.
*F25B 39/02* (2006.01)
*F25B 41/00* (2021.01)
(Continued)

(52) U.S. Cl.
CPC ..... *F25B 39/028* (2013.01); *F25B 41/00* (2013.01); *F25D 11/02* (2013.01); *F25D 17/02* (2013.01);
(Continued)

(58) Field of Classification Search
CPC ..... F25B 39/028; F25B 41/00; F25B 39/02; F25B 2600/2511; F28F 9/02
See application file for complete search history.

(56) References Cited

U.S. PATENT DOCUMENTS 5,211,222 A * 5/1993 Shinmura ..... F28D 1/035 165/153
2016/0076824 A1 3/2016 Matsuda et al.
(Continued)

FOREIGN PATENT DOCUMENTS

CN 105229404 A 1/2016
EP 2998681 A1 3/2016
(Continued)

OTHER PUBLICATIONS

Office Action dated Sep. 15, 2020 issued in corresponding JP patent application No. 2019-512155 and English translation).
(Continued)

*Primary Examiner* — Larry L Furdge
(74) *Attorney, Agent, or Firm* — Posz Law Group, PLC

(57) ABSTRACT

A distributor distributes fluid to plural fluid outlets, the fluid flowing from a fluid inlet. The distributor includes plural branching flow paths having an upstream branching flow path, and downstream branching flow paths located closer to the fluid outlets than is the upstream branching flow path, and an intermediate flow path provided between the upstream branching flow path and one or more of the downstream branching flow paths, the intermediate flow path connecting the upstream branching flow path and the at least one of the downstream branching flow paths. The intermediate flow path has one end connected to the upstream branching flow path at a position facing one of the
(Continued)

ends of the upstream branching flow path and the other end connected to one or more of the downstream branching flow paths at a center of the downstream branching flow path, and causes the fluid flowing from the one end to change a flow direction of the fluid and then flow out of the other end.

10 Claims, 9 Drawing Sheets

(51) Int. Cl.
*F25D 11/02* (2006.01)
*F25D 17/02* (2006.01)
*F28F 9/02* (2006.01)

(52) U.S. Cl.
CPC ..... *F28F 9/02* (2013.01); *F25B 39/02* (2013.01); *F25B 2600/2511* (2013.01)

(56) References Cited

U.S. PATENT DOCUMENTS

2016/0116231 A1* 4/2016 Higashiiue ..... F25B 39/00 165/174
2016/0169595 A1* 6/2016 Matsuda ..... F28F 9/0221 165/104.21
2016/0178292 A1 6/2016 Matsui et al.
2017/0328652 A1 11/2017 Matsui et al.
2018/0238637 A1* 8/2018 Ishibashi ..... F28F 1/06
2019/0049186 A1* 2/2019 Yoshimura ..... F25B 39/00

FOREIGN PATENT DOCUMENTS

WO 2014/184915 A1 11/2014
WO 2014184913 A1 11/2014
WO 2015/045073 A1 4/2015
WO 2016/071946 A1 5/2016
WO WO-2021009806 A1 * 1/2021 ..... F25B 41/00

OTHER PUBLICATIONS

Office Action dated Oct. 29, 2020 issued in corresponding CN patent application No. 201780087639.X (and English translation).
Chinese Office Action dated Apr. 9, 2021, issued in corresponding CN Patent Application No. 201780087639.X (and English Machine Translation).
International Search Report of the International Searching Authority dated Jul. 4, 2017 for the corresponding international application No. PCT/JP2017/015344 (and English translation).
Decision of Rejection dated Jun. 4, 2021, issued in corresponding CN Patent Application No. 201780087639.X (and English Machine Translation).
Office Action dated Nov. 30, 2021 issued in corresponding JP Patent Application No. 2019-512155 (and English Machine Translation).

* cited by examiner

Comparative Example

Comparative Example

DISTRIBUTOR, HEAT EXCHANGER, AND REFRIGERATION CYCLE APPARATUS

CROSS REFERENCE TO RELATED APPLICATION

This application is a U.S. national stage application of International Application No. PCT/JP2017/015344, filed on Apr. 14, 2017, the contents of which are incorporated herein by reference.

TECHNICAL FIELD

The present invention relates to a distributor used in a heating circuit or other circuits, a heat exchanger, and a refrigeration cycle apparatus.

BACKGROUND

A heat exchanger has a flow path in which a plurality of heat transfer tubes are arranged in parallel, to reduce the pressure loss of refrigerant flowing in the heat transfer tubes. To refrigerant inlets of the heat transfer tubes, for example, a header or a distributor that is a distribution device for equally distributing refrigerant to the heat transfer tubes is provided.

To secure the heat transfer performance of the heat exchanger, it is important to equally distribute the refrigerant to the plurality of heat transfer tubes.

As an example of such distributor, a distributor is proposed in which a plurality of plates are stacked to form a distribution flow path for dividing one inlet flow path into a plurality of outlet flow paths to thereby distribute and supply the refrigerant to each of the heat transfer tubes of the heat exchanger (see, for example, Patent Literature 1).

The distributor disclosed in Patent Literature 1 is formed by alternately stacking bare materials, or the plates applied with no brazing material and the clad materials, or the plates applied with brazing material, and distribution flow paths are formed by causing circular through holes and substantially Z-shaped through grooves that are formed in these plates to communicate with each other.

Patent Literature

Patent Literature 1: International Publication No. WO 2016/071946

In the distributor disclosed in Patent Literature 1, both ends of the substantially Z-shaped through groove (hereinafter, referred to as an upstream branching flow path) formed on the upstream portion are each formed at the same height position as a branch point (center point) of the corresponding one of the substantially Z-shaped through grooves (hereinafter, referred to as downstream branching flow paths) formed on the downstream portion in the gravity direction. As a result, it is conceivable that concentration of a liquid film in each of the ends of the upstream branching flow path will affect the distribution of the refrigerant at the branch point of each of the downstream branching flow paths.

When the concentration of the liquid film is significant, it is expected that it is difficult to adjust the distribution ratio of the refrigerant flow amount at the branch point of the downstream branching flow paths to a predetermined amount (target value). That is, as the refrigerant flows toward the downward branching flow path, it becomes more difficult to adjust the distribution ratio of the refrigerant flow amount. As a result, an appropriate amount of refrigerant cannot flow in the heat exchanger, thereby likely causing reduction in heat exchange efficiency and reduction in operation efficiency of the refrigeration cycle.

SUMMARY

The present invention has been made in view of the above-described problems, and has an object to provide a distributor capable of distributing refrigerant so that an appropriate amount of refrigerant flows up to downstream branching flow paths, a heat exchanger, and a refrigeration cycle apparatus.

A distributor of one embodiment of the present invention is a distributor for distributing fluid to a plurality of fluid outlets, the fluid flowing from a fluid inlet, the distributor including a plurality of branching flow paths having an upstream branching flow path, and downstream branching flow paths located closer to the plurality of fluid outlets than is the upstream branching flow path, and an intermediate flow path provided between the upstream branching flow path and at least one of the downstream branching flow paths, the intermediate flow path connecting the upstream branching flow path and the at least one of the downstream branching flow paths. The intermediate flow path has one end connected to the upstream branching flow path and an other end connected to the at least one of the downstream branching flow paths, and causes the fluid flowing from the one end to change a flow direction of the fluid and then flow out of the other end.

A heat exchanger of another embodiment of the present invention includes the distributor, and a plurality of heat transfer tubes into which the fluid flowing out of the plurality of fluid outlets of the distributor flows.

A refrigeration cycle apparatus of still another embodiment of the present invention includes the heat exchanger serving as at least one of an evaporator and a condenser.

In the distributor of an embodiment of the present invention, as the intermediate flow path causes the fluid flowing from the one end to change a flow direction of the fluid and then flow out of the other end, the intermediate flow path can prevent the fluid from flowing straight from the upstream branching flow path to the downstream branching flow paths, and the fluid can be branched in a homogeneously mixed state.

As the heat exchanger of another embodiment of the present invention includes the distributor, the fluid can flow in a homogeneous state, thereby improving the heat exchange efficiency.

As the refrigeration cycle apparatus of still another embodiment of the present invention includes the heat exchanger, refrigerant can flow to each path in the heat exchanger in a homogeneous state to thereby maximize the performance of the heat exchangers.

DETAILED DESCRIPTION

Figure 1:
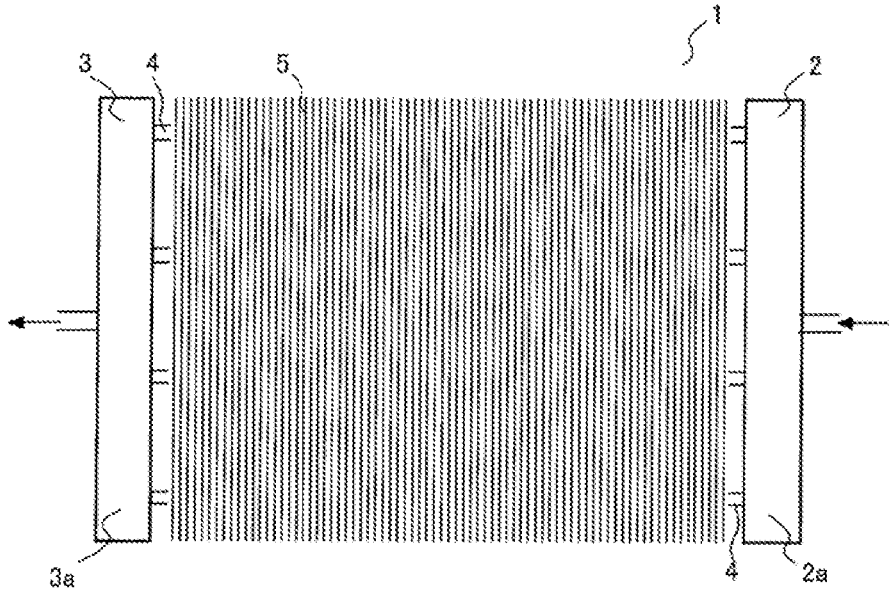
FIG. 1 is a diagram schematically illustrating a heat exchanger according to Embodiment 1 of the present invention.

Hereinafter, a distributor, a heat exchanger, and a refrigeration cycle apparatus according to the present invention will be described with reference to the drawings.

The configuration, operation, and other matters described below are merely examples, and the distributor, the heat exchanger, and the refrigeration cycle apparatus according to the present invention are not limited to such configuration, operation, and other matters. In the drawings, the same or similar components are denoted by the same reference signs, or the reference signs for the components are omitted. The illustration of details in the structure is appropriately simplified or omitted. Furthermore, overlapping description or similar description is appropriately simplified or omitted.

The following description is made on a case in which the distributor, the heat exchanger, and the refrigeration cycle apparatus according to the present invention are used in an air-conditioning apparatus, but the present invention is not limited to such a case. For example, the distributor, the heat exchanger, and the refrigeration cycle apparatus according to the present invention may be used in any other refrigeration cycle apparatus including a refrigerant cycle circuit. Furthermore, the following description is made on a case in which the refrigeration cycle apparatus is capable of switching between a heating operation and a cooling operation, but the refrigeration cycle apparatus is not limited to such a case. The refrigeration cycle apparatus may perform the heating operation or the cooling operation only.

Embodiment 1

A distributor and a heat exchanger according to Embodiment 1 of the present invention will be described.

<Configuration of Heat Exchanger 1>

Hereinafter, a schematic configuration of a heat exchanger 1 according to Embodiment 1 will be described.

FIG. 1 is a diagram schematically illustrating a configuration of the heat exchanger 1 according to Embodiment 1. In FIG. 1, the flow direction of fluid is represented by the solid arrows. The following description is made using refrigerant as an example of fluid.

As illustrated in FIG. 1, the heat exchanger 1 includes a first distributor 2, a second distributor 3, a plurality of heat transfer tubes 4, and a plurality of fins 5. The second distributor 3 may be the same type of distributor as the first distributor 2 or may be a different type than the first distributor 2.

At least one distribution flow path 2*a* is formed in the first distributor 2. A refrigerant pipe is connected to an inflow end of the distribution flow path 2*a*. The plurality of heat transfer tubes 4 are connected to an outflow end of the distribution flow path 2*a*.

The first distributor 2 corresponds to a "distributor" of the present invention.

A confluence flow path 3*a* is formed in the second distributor 3. The plurality of heat transfer tubes 4 are connected to the inflow end of the confluence flow path 3*a*. A refrigerant pipe is connected to the outflow end of the confluence flow path 3*a*.

The heat transfer tubes 4 are each a flat tube or a circular tube having a plurality of flow paths formed in the heat transfer tube 4. The heat transfer tubes 4 are each made of, for example, aluminum. The plurality of fins 5 are joined to the heat transfer tubes 4.

The fins 5 are each made of, for example, aluminum. The heat transfer tubes 4 are joined to the fins 5 by brazing, for example. Although FIG. 1 illustrates a case in which the four heat transfer tubes 4 are provided, the number of the heat transfer tubes 4 is not limited to four. In Embodiment 1, description will be made of an example in which the heat transfer tubes 4 are each a flat tube.

<Refrigerant Flow in Heat Exchanger>

Hereinafter, refrigerant flow in the heat exchanger 1 will be described.

Refrigerant flowing through the refrigerant pipe flows into the first distributor 2, is distributed in the distribution flow path 2*a*, and then flows out to the plurality of heat transfer tubes 4. In the plurality of heat transfer tubes 4, the refrigerant exchanges heat with, for example, air supplied by a fan. The refrigerant flowing through the plurality of heat transfer tubes 4 flows into the confluence flow path 3*a* of the second distributor 3, and then flow out to the refrigerant pipe. In the heat exchanger 1, the refrigerant can flow oppositely, that is, can flow from the second distributor 3 to the first distributor 2.

<Configuration of First Distributor 2>

Hereinafter, a configuration of the first distributor 2 will be described. First, the description will be made of an example in which the first distributor 2 is a stacking-type header.

Figure 2:
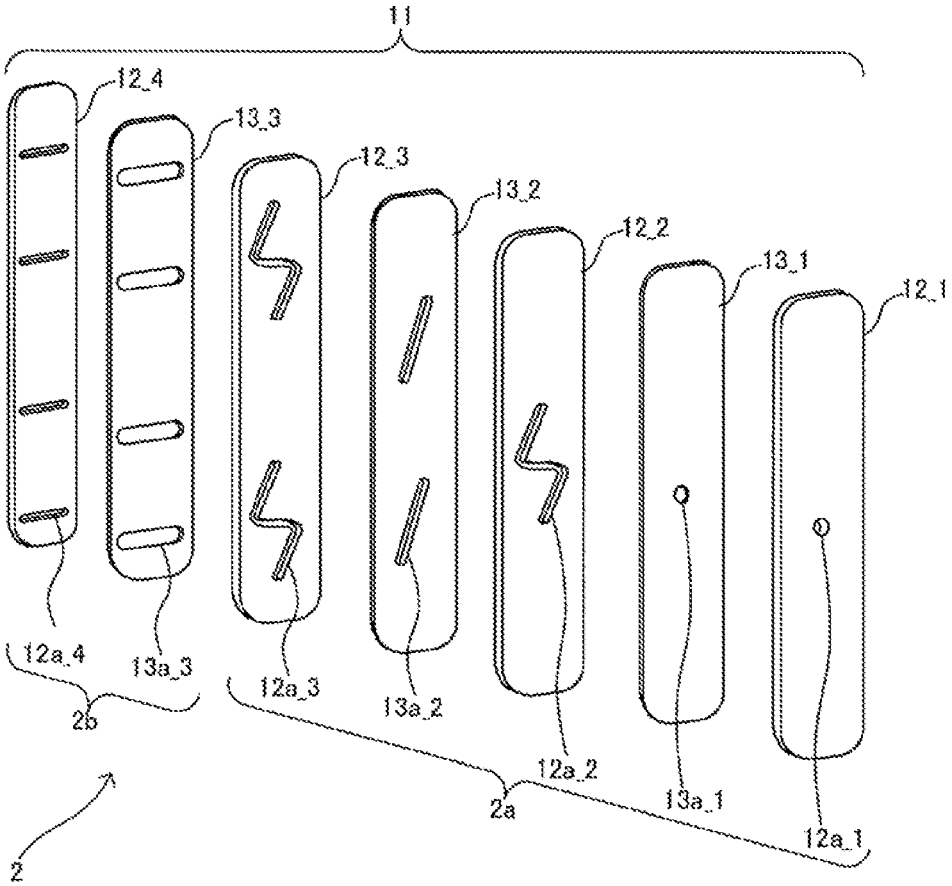
FIG. 2 is an exploded perspective view illustrating a distributor according to Embodiment 1 of the present invention.

FIG. 2 is an exploded perspective view illustrating the first distributor 2.

As illustrated in FIG. 2, the first distributor 2 includes a plate unit 11. The plate unit 11 is formed by alternately stacking a first plate 12_1 to a first plate 12_4 as bare materials, and a second plate 13_1 to a second plate 13_3 as clad materials. The first plate 12_1 and the first plate 12_4 are stacked on the plate unit 11 in the stacking direction. In the following, in some cases, the first plate 12_1 to the first plate 12_4 are collectively referred to as the first plates 12. Similarly, in some cases, the second plate 13_1 to the second plate 13_3 are correctively referred to as the second plates 13.

The first plates 12 are each made of, for example, aluminum. The thickness of each of the first plates 12 is, for example, about 1 to 10 mm. No brazing material is applied to the first plates 12. A through hole **12*a*_1 to through holes 12*a*_3 are provided in the corresponding ones of the first plates 12, to form part of the distribution flow path 2*a*. The through hole 12*a*_1 to through holes 12*a*_4 each pass through the front and back of the corresponding one of the first plates 12. When the first plates 12 and the second plates 13 are stacked, the through hole 12*a*_1 to the through holes 12*a*_3 serve as part of the distribution flow path 2*a***.

The through hole **12*a*_1** serves as a fluid inlet from which the refrigerant flows in.

Ends of the through holes **12*a*_3** each serve as a fluid outlet out of which the refrigerant flows.

As the through holes **12*a*_4 serve as part of a heat transfer tube inserting part 2*b*, no refrigerant flows in the through holes 12*a*_4**.

The second plates 13 are each made of, for example, aluminum. The thickness of each of the second plates 13 is, for example, about 1 to 10 mm, and the second plates 13 are each formed thinner than the first plates 12. A brazing material is applied to at least the front and back surfaces of the second plates 13. A through hole **13*a*_1 and through holes 13*a*_2 are provided in the corresponding ones of second plates 13, to form part of the distribution flow path 2*a*. The through hole 13*a*_1 to through holes 13*a*_3 each pass through the front and back of the corresponding one of the second plates 13. When the first plates 12 and the second plates 13 are stacked, the through hole 13*a*_1 and the through holes 13*a*_2 serve as part of the distribution flow path 2*a***.

As the through holes **13*a*_3 serve as part of a heat transfer tube inserting part 2*b*, no refrigerant flows in the through holes 13*a*_3**.

The through hole **12*a*_1 provided to pass through the first plate 12_1 and the through hole 13*a*_1 provided to pass through the second plate 13_1 each have a circular shape in a flow path cross section. The refrigerant pipe is connected to the through hole 12*a*_1 serving as the fluid inlet. For example, a fitting or other such component may be provided on the surface of the first plate 12_1 that is the refrigerant inflow surface, and the refrigerant pipe may be connected to the through hole 12*a*_1 through the fitting or other such component. Alternatively, the inner peripheral surface of the through hole 12*a*_1 may be shaped to be fitted to the outer peripheral surface of the refrigerant pipe so that the refrigerant pipe may be directly connected to the through hole 12*a*_1** without using the fitting or other such component.

Note that the flow path cross section is a cross section of the flow path taken in a direction perpendicular to the refrigerant flow direction.

The through hole **12*a*_2 provided to pass through the first plate 12_2 and the through holes 12*a*_3 provided to pass through the first plate 12_3 each have, for example, a Z-shape in a flow path cross section. The through hole 12*a*_2 and the through holes 12*a*_3 each serve as a branching flow path for branching the refrigerant vertically in the gravity direction. The through hole 13*a*_1 in the second plate 13_1 is provided at a position facing the center of the through hole 12*a*_2**.

The through holes **13*a*_2 provided to pass through the second plate 13_2 each have, for example, an oval shape (including an elliptical shape) in a flow path cross section. The through holes 13*a*_2 each serve as an intermediate flow path (connecting flow path) that is not a flow path for branching the refrigerant. That is, the through holes 13*a*_2 are each provided between the through hole 12*a*_2 serving as an upstream branching flow path and the corresponding one of the through holes 12*a*_3 each serving as a downstream branching flow path located closer to a plurality of fluid outlets than is the upstream branching flow path, and are provided to connect the through hole 12*a*_2 and the through holes 12*a*_3** so that the refrigerant does not travel straight.

More specifically, one end of each of the through holes **13*a*_2 in the second plate 13_2 is placed at a position facing the corresponding one of ends of the through hole 12*a*_2. The other end of each of the through holes 13*a*_2 in the second plate 13_2 is placed at a position facing the center of the corresponding one of the through holes 12*a*_3. Consequently, the two ends of each of the through holes 13*a*_2 are located not to overlap with each other, when the through holes 13*a*_2 are viewed from the refrigerant flow direction, that is, one of the two ends that is connected to the through hole 12*a*_2 (an end 120 illustrated in FIG. 7 and FIG. 8) and the other of the two ends that is connected to the through holes 12*a*_3 (an end 121 illustrated in FIG. 7 and FIG. 8) are located not to overlap with each other, resulting that the through holes 13*a*_2** each extend in the gravity direction so that the refrigerant does not travel straight.

Note that the refrigerant flow direction is a flow direction of the refrigerant flowing through the through hole **12*a*_1 and the through hole 13*a*_1**.

Figure 7:
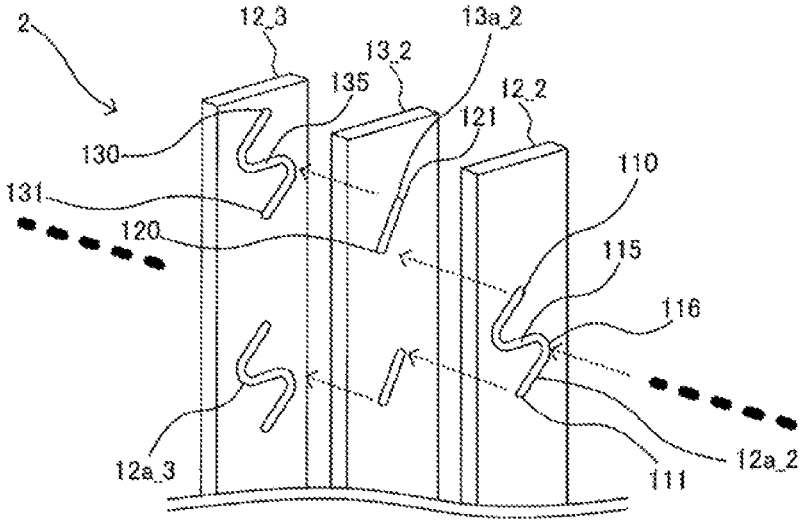
FIG. 7 is an exploded perspective view for illustrating a refrigerant flow in the distributor according to Embodiment 1 of the present invention.
Figure 8:
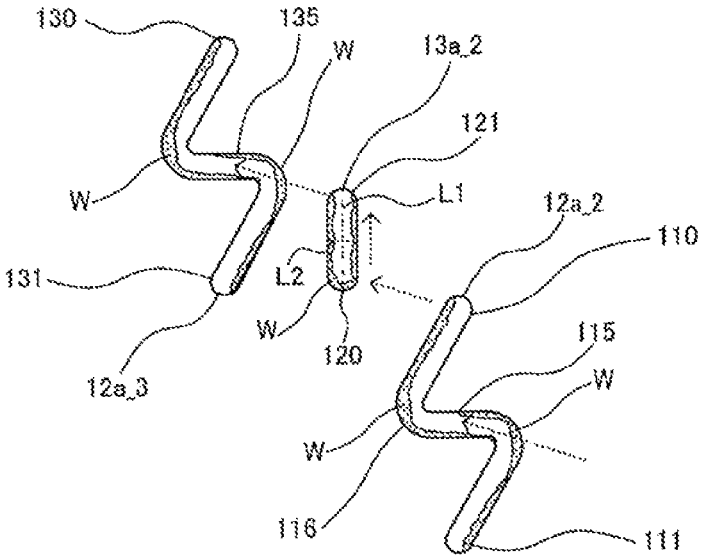
FIG. 8 is a schematic diagram for illustrating the refrigerant flow in the distributor according to Embodiment 1 of the present invention.

The through holes **13*a*_3 in the second plate 13_3 stacked on the surface of the first plate 12_3 that is opposite to the second plate 13_2 are provided at respective positions facing both ends of the through holes 12*a*_3 (ends 130 and ends 131 illustrated in FIG. 7 and FIG. 8**).

When the first plates 12 and the second plates 13 are stacked, the through holes adjacent to one another communicate with one another, and the through holes are closed by their respective adjacent first plates 12 or their respective adjacent second plates 13 except for the communicated portions in the through holes. As a result, the distribution flow path **2*a*** is formed.

The through hole **12*a*_2 and the through holes 12*a*_3 that each serve as the branching flow path are located in different layers in the horizontal direction, in a state in which the first plates 12 and the second plates 13** are stacked.

Although FIG. 1 illustrates an example in which in the first distributor 2, the distribution flow path **2*a*** has one fluid inlet and four fluid outlets, the number of branches is not intended to be limited to four.

The number of first plates 12 and second plates 13 that are stacked is not intended to be limited to the number illustrated in FIG. 2.

As illustrated in FIG. 2, the through holes **12*a*_4 provided in the first plate 12_4 and the through holes 13*a*_3 provided in the second plate 13_3 are each placed to face an end of the corresponding one of the through holes 12*a*_3, and serve as the heat transfer tube inserting part 2*b* into which tip portions of the heat transfer tubes 4 are to be inserted. That is, the through holes 12***a*_4 and the through holes 13*a*_3 are each placed on an extension line of the corresponding one of the heat transfer tubes 4, and each have a shape conforming to the outer peripheral surface of the heat transfer tube 4. The heat transfer tubes 4 are each inserted into the corresponding set of the through holes 12*a*_4 and the through holes 13*a*_3, to be connected to the first distributor 2.

The inner peripheral surface of each of the through holes 12*a*_4 of the first plate 12_4 is fitted to the outer peripheral surface of the corresponding one of the heat transfer tubes 4. It is preferred that the surfaces are fitted to each other with a gap that allows entry of the heated brazing material because of a capillary phenomenon.

<Flow of Refrigerant in First Distributor 2 that is Stacking-Type Header>

Hereinafter, the flow of the refrigerant in the first distributor 2 will be described.

Figure 3:
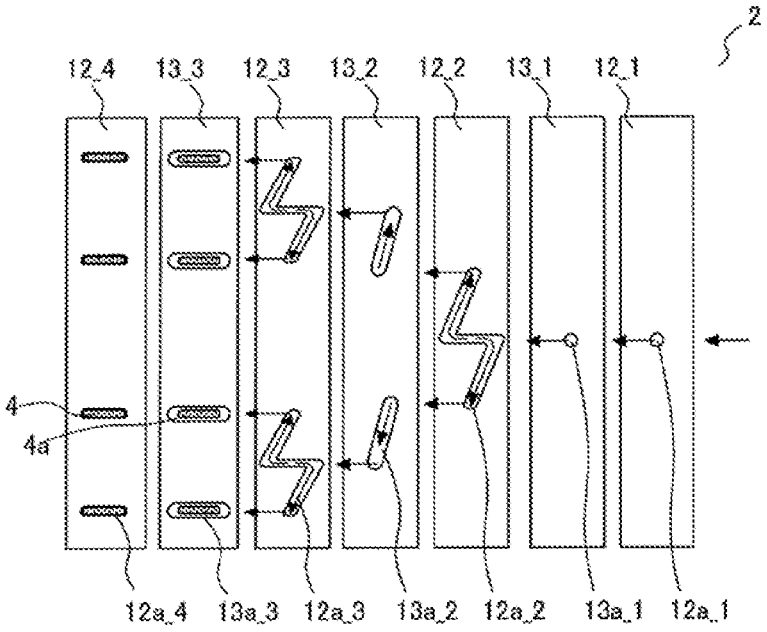
FIG. 3 is a developed view of the distributor according to Embodiment 1 of the present invention.
Figure 4:
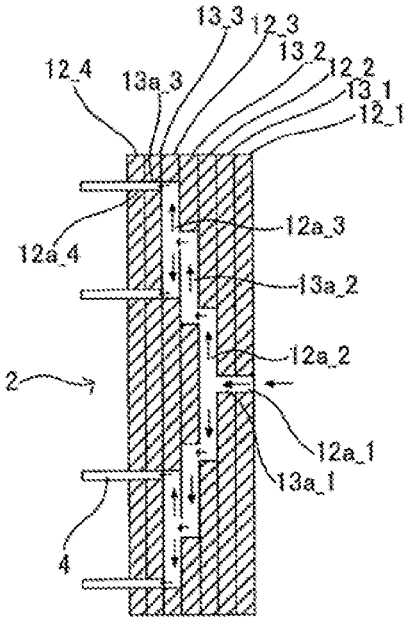
FIG. 4 is a longitudinal sectional view of the distributor according to Embodiment 1 of the present invention.

FIG. 3 is a developed view of the first distributor 2. FIG. 4 is a longitudinal sectional view of the first distributor 2.

In each of FIG. 3 and FIG. 4, the refrigerant flow direction is represented by the solid arrows. FIG. 4 illustrates the plates having a substantially uniform thickness, for the convenience of the description. FIG. 4 illustrates a cross section taken along the refrigerant flow direction.

As illustrated in FIG. 3 and FIG. 4, the refrigerant having flowed through the refrigerant pipe flows into the first distributor 2 from the through hole 12*a*_1 in the first plate 12_1, the through hole 12*a*_1 serving as the fluid inlet. The refrigerant having flowed through the through hole 12*a*_1 flows into the through hole 13*a*_1 in the second plate 13_1.

The refrigerant having flowed into the through hole 13*a*_1 in the second plate 13_1 from the through hole 12*a*_1 in the first plate 12_1 flows into the center of the through hole 12*a*_2 in the first plate 12_2. The refrigerant having flowed into the center of the through hole 12*a*_2 in the first plate 12_2 hits against the surface of the second plate 13_2 stacked adjacent to the first plate 12_2, and branches in two directions (left and right directions) to flow to both ends of the through hole 12*a*_2 in the first plate 12_2. The refrigerant having flowed into each of the both ends of the through hole 12*a*_2 in the first plate 12_2 flows into one end of the corresponding one of the through holes 13*a*_2 in the second plate 13_2.

The refrigerant having flowed into the one end of each of the through holes 13*a*_2 in the second plate 13_2 flows to the other end of the corresponding one of the through holes 13*a*_2 in the second plate 13_2. The refrigerant having reached the other end of each of the through holes 13*a*_2 of the second plate 13_2 flows into the center of the corresponding one of the through holes 12*a*_3 of the first plate 12_3.

The refrigerant having flowed into the center of each of the through holes 12*a*_3 in the first plate 12_3 hits against the surface of the second plate 13_3 stacked adjacent to the first plate 12_3, and branches in two directions (left and right directions) to flow to both ends of the through hole 12*a*_3 in the first plate 12_3. Ends of the through holes 12*a*_3 in the first plate 12_3 each serve as the fluid outlet.

The refrigerant having reached each of the both ends of the through holes 12*a*_3 in the first plate 12_3 flows into the corresponding one of the heat transfer tubes 4 through tip portions 4*a* of the heat transfer tubes 4 each located in the corresponding one of the through holes 12*a*_3.

The refrigerant having flowed into the heat transfer tubes 4 passes through the respective regions in the heat transfer tubes 4, which are inside the through holes 13*a*_3 in the second plate 13_3 and inside the through holes 12*a*_4 in the first plate 12_4, to thereby flow into regions in the heat transfer tubes 4 to which the fins 5 are joined.

<Regarding Through Holes 13*a*_2>

Figure 5:
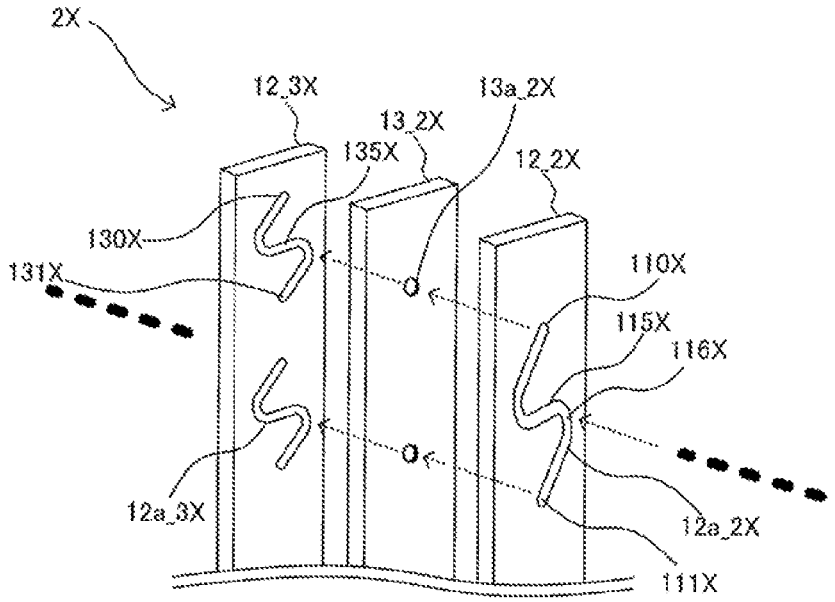
FIG. 5 is an exploded perspective view for illustrating a refrigerant flow in a distributor as a comparative example.
Figure 6:
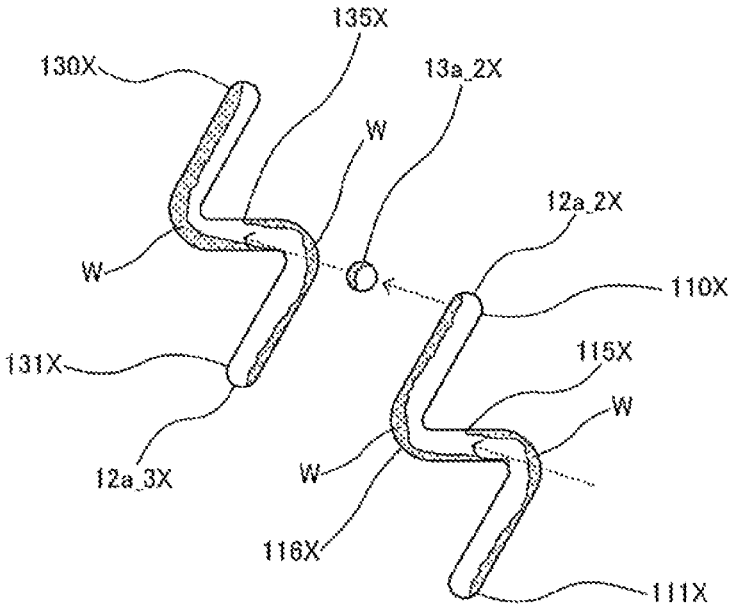
FIG. 6 is a schematic diagram for illustrating the refrigerant flow in the distributor as the comparative example.

FIG. 5 is an exploded perspective view for illustrating the refrigerant flow in the distributor (hereinafter referred to as a distributor 2X) as a comparative example. FIG. 6 is a schematic diagram for illustrating the refrigerant flow in the distributor 2X. First, the refrigerant flow in the distributor 2X will be described with reference to FIG. 5 and FIG. 6. Note that in FIG. 5 and FIG. 6, "X" is attached at the end of the reference sign representing each component of the distributor 2X that are equivalent to each component of the first distributor 2, to distinguish the components of the distributor 2X from those of the first distributor 2. In FIG. 5 and FIG. 6, the refrigerant flow is represented by the dashed arrows.

In FIG. 5 and FIG. 6, a portion serving as the branching flow path including the center of the through hole 12*a*_2X in the first plate 12_2X is illustrated as a branching portion 115X, one end of the through hole 12*a*_2X in the first plate 12_2X is illustrated as an end 110X, the other end of the through hole 12*a*_2X in the first plate 12_2X is illustrated as an end 111X, and a bending portion of the flow path is illustrated as a bending portion 116X.

In FIG. 5 and FIG. 6, portions each serving as the branching flow path including the center of the corresponding one of the through holes 12*a*_3X in the first plate 12_3X are each illustrated as a branching portion 135X, one end of each of the through holes 12*a*_3X in the first plate 12_3X is illustrated as an end 130X, and the other end of each of the through holes 12*a*_3X in the first plate 12_3X is illustrated as an end 131X.

The refrigerant having flowed through the refrigerant pipe flows into the distributor 2X, and flows into the branching portion 115X of the through hole 12*a*_2X in the first plate 12_2X. The refrigerant having flowed through the branching portion 115X hits against the surface of the second plate 13_2X stacked adjacent to the first plate 12_2X, and branches in two directions to flow to the end 110X and the end 111X of the through hole 12*a*_2X. The liquid refrigerant having a large density (refrigerant W illustrated in FIG. 6) in the two-phase gas-liquid refrigerant flowing the bending portion 116X of the through hole 12*a*_2X serving as the branching flow path concentrates at outside part in the bending portion 116X of the through hole 12*a*_2X by the centrifugal force. That is, the liquid film is in a concentrating state at each of the end 110X and the end 111X of the through hole 12*a*_2X.

When the refrigerant having reached the end 110X and the end 111X of the through hole 12*a*_2X in this state travels straight through the respective through holes 13*a*_2X in the second plate 13_2X, and then flows into the respective through holes 12*a*_3X in the first plate 12_3X located downstream of the second plate 13_2X, the through holes 12*a*_3X each serving as the branching flow path. Consequently, in the through holes 12*a*_3X in the first plate 12_3X, the liquid refrigerant flows into the outside part in which the liquid film concentrates, by a larger amount. In particular, when the concentration of the liquid film is significant, it is difficult to adjust a distribution ratio of the refrigerant flow amount in each of the through holes 12*a*_3X in the first plate 12_3X to a predetermined amount (target value), for example, to branch the refrigerant flow at a ratio of 50%:50%.

FIG. 7 is an exploded perspective view for illustrating a refrigerant flow in the first distributor 2. FIG. 8 is a schematic diagram for illustrating the refrigerant flow in the first distributor 2. Next, the refrigerant flow in the first distributor 2 will be described with reference to FIG. 7 and FIG. 8. Note that in FIG. 7 and FIG. 8, the refrigerant flow is represented by the dashed arrows.

In FIG. 7 and FIG. 8, a portion serving as the branching flow path including the center of the through hole 12*a*_2 in the first plate 12_2 is illustrated as a branching portion 115, one end of the through hole 12*a*_2 in the first plate 12_2 is illustrated as an end 110, the other end of the through hole 12*a*_2 in the first plate 12_2 is illustrated as an end 111, and a bending portion of the flow path is illustrated as a bending portion 116. Note that the through hole 12*a*_2 serves as an upstream branching flow path.

In FIG. 7 and FIG. 8, portions each serving as the branching flow path including the center of the corresponding one of the through holes 12*a*_3 in the first plate 12_3 are each illustrated as a branching portion 135, one end of each of the through holes 12*a*_3 in the first plate 12_3 is illustrated as an end 130, and the other end of each of the through holes 12*a*_3 in the first plate 12_3 is illustrated as an end 131. Note that the through holes 12*a*_3 each serve as a downstream branching flow path.

Furthermore, in FIG. 7 and FIG. 8, one end of each of the through holes 13*a*_2 in the second plate 13_2, the one end serving as the refrigerant inlet, is illustrated as an end 120, and the other end of each of the through holes 13*a*_2 in the second plate 13_2, the other end serving as the refrigerant outlet, is illustrated as an end 121.

Note that in FIG. 8, a portion connecting the end 120 and the end 121 is illustrated as a virtual line L1, and a portion perpendicular to the portion connecting the end 120 and the end 121 is illustrated as a virtual line L2.

The refrigerant having flowed through the refrigerant pipe flows into the first distributor 2, and flows into the branching portion 115 of the through hole 12*a*_2 serving as the upstream branching flow path. The refrigerant having flowed through the branching portion 115 hits against the surface of the second plate 13_2 stacked adjacent to the first plate 12_2, and branches in two directions (left and right directions) to flow to the end 110 and the end 111 of the through hole 12*a*_2. The liquid refrigerant having a large density (refrigerant W illustrated in FIG. 8) in the two-phase gas-liquid refrigerant flowing the bending portion 116 of the through hole 12*a*_2 serving as the branching flow path concentrates at outside part in the bending portion 116 of the through hole 12*a*_2 by the centrifugal force, in the same manner as the distributor 2X. That is, the liquid film is in a concentrating state at each of the end 110 and the end 111 of the through hole 12*a*_2.

When the refrigerant having reached each of the end 110 and the end 111 of the through hole 12*a*_2 in this state flows into the corresponding one of the ends 120 of the respective through holes 13*a*_2 in the second plate 13_2 serving as an intermediate flow path. The refrigerant having flowed into the ends 120 hits against the surface of the first plate 12_3 stacked adjacent to the second plate 13_2, and the liquid film is scattered. That is, the two-phase gas-liquid refrigerant collides with the planar surface (the surface of the first plate 12_3) facing the through holes 13*a*_2, and thereby the liquid film is scattered.

More specifically, the through holes 13*a*_2 each serving as the intermediate flow path is configured so that the refrigerant having flowed from the ends 120 hits against the surface of the first plate 12_3 stacked adjacent to the second plate 13_2 to change the flow direction and then flow out of the ends 121.

Thereby, the liquid film of the refrigerant flowing through the through holes 13*a*_2 is prevented from concentrating, thereby is brought closer to the two-phase gas-liquid state in which the gas phase and the liquid phase are homogeneously mixed. The refrigerant having reached the ends 121 while maintaining this state flows into the respective through holes 12*a*_3 each serving as the downstream branching flow path. That is, as the through holes 13*a*_2 prevent the refrigerant from flowing straight from the through hole 12*a*_2 to the respective through holes 12*a*_3, the refrigerant state similar to that in the through hole 12*a*_2 serving as the upstream branching flow path can be also obtained each in the through holes 12*a*_3 each serving as the downstream branching flow path.

Note that the through holes 13*a*_2 are each only required to have the size and shape that allow the refrigerant flowing from the upstream branching flow path to change the flow direction and flow out to the downstream branching flow paths. For example, the through holes 13*a*_2 is preferably provided in such a manner that the flow path length of the portion connecting the end 120 and the end 121 as represented by the virtual line L1 is at least two times greater than the flow path width of the portion perpendicular to the portion connecting the end 120 and the end 121 as represented by the virtual line L2. Thus, the through holes 13*a*_2 can prevent the refrigerant from flowing straight from the through holes 13*a*_2 to the respective through holes 12*a*_3.

Thus, as the liquid film is prevented from concentrating in the through holes 12*a*_3 in the first plate 12_3, the refrigerant flows in a substantially homogeneous state. Consequently, it becomes possible to adjust a distribution ratio of the refrigerant flow amount in each of the through holes 12*a*_3 serving as the downstream branching flow path to a predetermined amount (target value), for example, to branch the refrigerant flow at a ratio of 50%:50%.

Next, the description will be made of an example in which the first distributor 2 is an integrated-type header.

Figure 9:
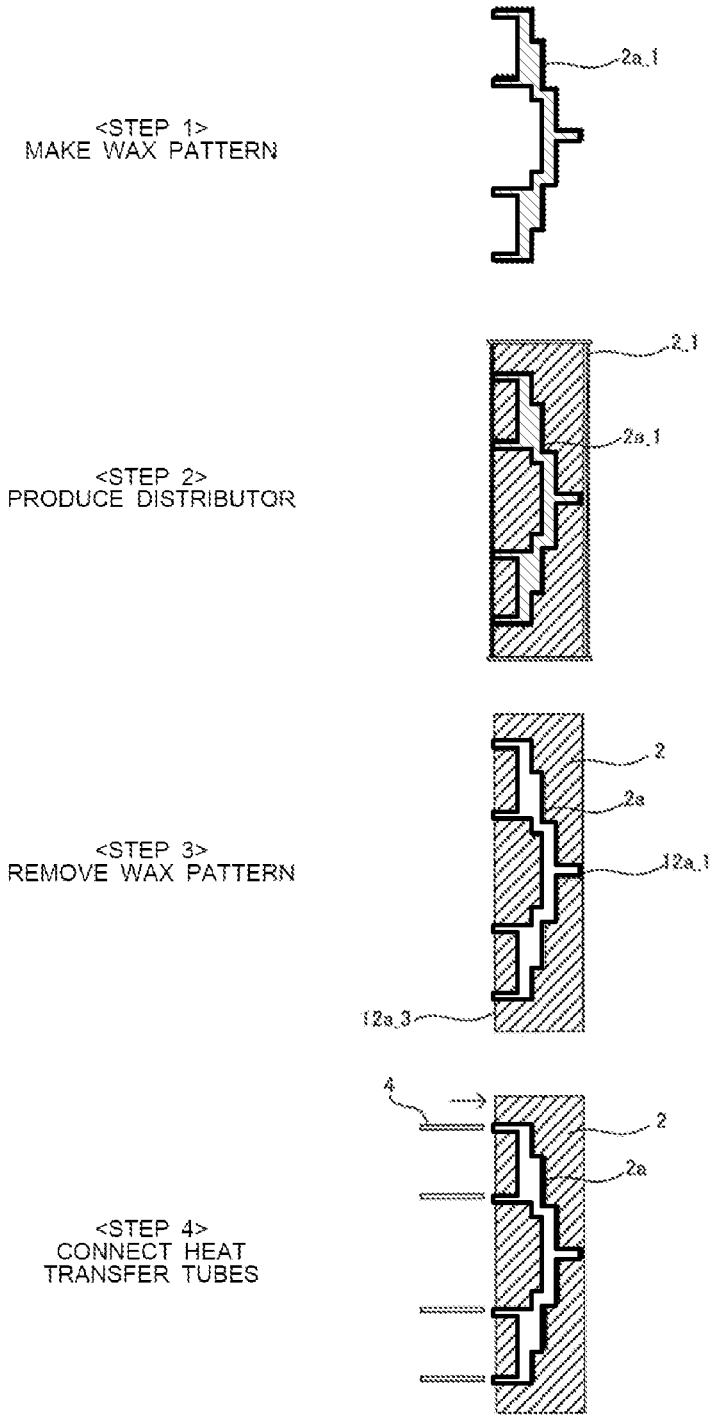
FIG. 9 is a diagram illustrating a flow of a method of manufacturing the heat exchanger according to Embodiment 1 of the present invention.
Figure 10:
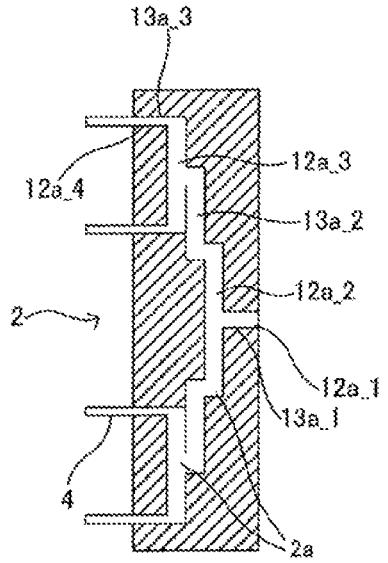
FIG. 10 is a longitudinal sectional view of the distributor according to Embodiment 1 of the present invention using a lost wax process.

FIG. 9 is a diagram illustrating a flow of a method of manufacturing the heat exchanger 1. FIG. 10 is a longitudinal sectional view of the first distributor 2 using a lost wax process. First, a method of manufacturing the first distributor 2 using the lost wax process will be described.

In Step 0 not illustrated, a mold is made to form the distribution flow path 2*a* of the first distributor 2. In Step 1, the wax is poured into the mold made in Step 0 to make a wax mold (a wax pattern 2*a*_1) having the same shape as the distribution flow path 2*a*. In Step 2, the wax pattern 2*a*_1 is fixed to a mold 2_1 for forming the first distributor 2, and the molten aluminum is poured into the mold.

In Step 3, the solidified aluminum is heated to melt out the wax pattern 2*a*_1 fixed to the inside of the aluminum. Thereby, the first distributor 2 in which the distribution flow path 2*a* is formed is produced. In Step 0 to Step 3, the first distributor 2 is completed.

Then, in Step 4, the heat transfer tubes 4 are connected to the first distributor 2, and other assembling and processing operations are performed to complete the heat exchanger 1.

The first distributor 2 produced by the lost wax process is different from the first distributor 2 configured as the stacking-type header illustrated in FIG. 2 to FIG. 4 in that the plate unit 11 is not provided as illustrated in FIG. 10. Note that all functions of the first distributor 2 produced by the lost wax process is the same as those of the first distributor 2 configured as the stacking-type header.

<Flow of Refrigerant in First Distributor 2 that is Integrated-Type Header>

Figure 11:
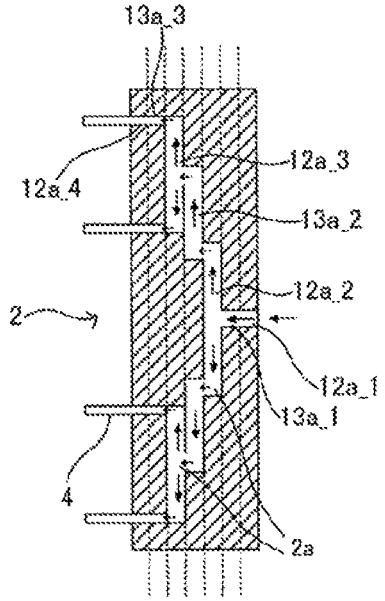
FIG. 11 is a longitudinal sectional view illustrating a refrigerant flow in the distributor according to Embodiment 1 of the present invention that is completed by the manufacturing method of FIG. 9.

Hereinafter, the flow of the refrigerant in the first distributor 2 will be described. FIG. 11 is a longitudinal sectional view illustrating a refrigerant flow in the first distributor 2 that is completed by the manufacturing method of FIG. 9. In FIG. 11, components, components corresponding to portions, or portions of the first distributor 2 illustrated in FIG. 4 are illustrated using the same reference signs. In addition, FIG. 11 illustrates the correspondence between the first distributor 2 completed by the manufacturing method in FIG. 9 and the plates of the first distributor 2 illustrated in FIG. 4, the plates being represented by the dashed lines. FIG. 11 illustrates the plates having a substantially uniform thickness, for the convenience of the description. FIG. 11 illustrates a cross section taken along the refrigerant flow direction. Furthermore, in FIG. 11, the refrigerant flow direction is represented by the solid arrows.

The basic refrigerant flow is the same as the refrigerant flow of the first distributor 2 configured as the stacking-type header illustrated in FIG. 3 and FIG. 4.

The refrigerant having flowed through the refrigerant pipe flows into the first distributor 2 from the through hole 12*a*_1 in the first distributor 2, the through hole 12*a*_1 serving as the fluid inlet. The refrigerant having flowed through the through hole 12*a*_1 flows into the through hole 13*a*_1, and flows into the center of the through hole 12*a*_2. The refrigerant having flowed into the center of the through hole 12*a*_2 branches in two directions (left and right directions) to flow to both ends of the through hole 12*a*_2. The refrigerant having reached each of the ends of the through hole 12*a*_2 flows into one end of the corresponding one of the through holes 13*a*_2.

The refrigerant having flowed into the one end of each of the through holes 13*a*_2 flows to the other end of the corresponding one of the through holes 13*a*_2, and flows into the center of the corresponding one of the through holes 12*a*_3. The refrigerant having flowed into the center of each of the through holes 12*a*_3 branches in two directions (left and right directions) to flow to both ends of the through hole 12*a*_3. Ends of the through holes 12*a*_3 each serve as the fluid outlet, and the refrigerant having reached each of the ends of the through holes 12*a*_3 flows into the corresponding one of the heat transfer tubes 4 from the tip portions 4*a* of the heat transfer tubes 4 located in the through holes 12*a*_3.

The refrigerant having flowed into the heat transfer tubes 4 passes through the respective regions in the heat transfer tubes 4, which are inside the through holes 13*a*_3 and inside the through holes 12*a*_4, to thereby flow into regions in the heat transfer tubes 4 to which the fins 5 are joined.

<Function and Effect of First Distributor 2 and Heat Exchanger 1>

As described above, in the first distributor 2, as the through holes 13*a*_2 each serving as the connecting flow path are formed, the refrigerant can also branch in the two-phase gas-liquid state in which the gas phase and the liquid phase are homogeneously mixed, each in the downstream through holes 13*a*_2 each serving as the branching flow path. Thus, in the first distributor 2, as the liquid film is prevented from concentrating at both of the upstream branching flow path and the downstream branching flow paths, the distribution ratio of the refrigerant flow amount can be adjusted to a predetermined amount (target value), and the excellent distribution performance can be achieved.

As the heat exchanger 1 includes the first distributor 2, the refrigerant can flow into each path in the homogeneous state, to thereby improve the heat exchange efficiency.

Embodiment 2

A distributor according to Embodiment 2 of the present invention will be described.

In Embodiment 2, features different from those of Embodiment 1 will be mainly described, and the same reference signs are used for the same parts as those of Embodiment 1, and the description of the same parts is omitted.

Note that as a heat exchanger including the distributor according to Embodiment 2 is the same as the heat exchanger 1 described in Embodiment 1, the description of the heat exchanger is omitted. The distributor according to Embodiment 2 is referred to as a first distributor 2A.

<Configuration of Distributor According to Embodiment 2>

Hereinafter, a configuration of the first distributor 2A will be described. Here, the description will be made of an example in which the first distributor 2A is a stacking-type header. Note that the first distributor 2A may be an integrated-type header. In this case, the first distributor 2A is only required to be produced with reference to FIG. 9.

Figure 12:
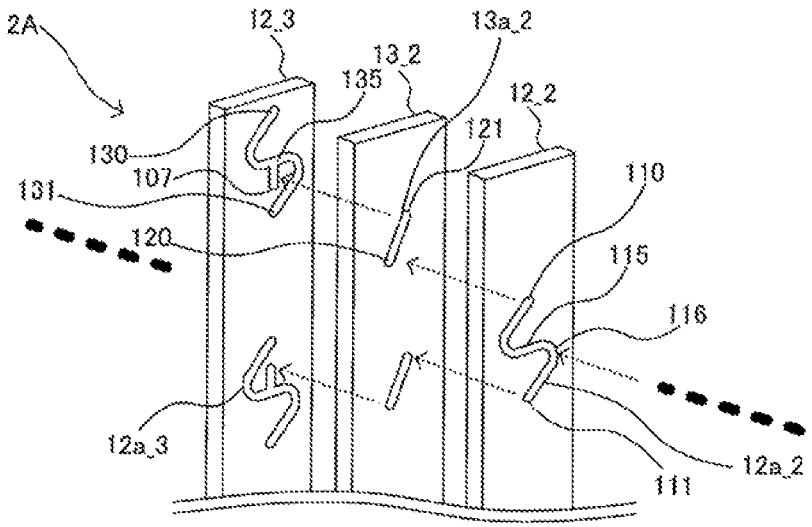
FIG. 12 is an exploded perspective view for illustrating a refrigerant flow in a distributor according to Embodiment 2 of the present invention.
Figure 13:
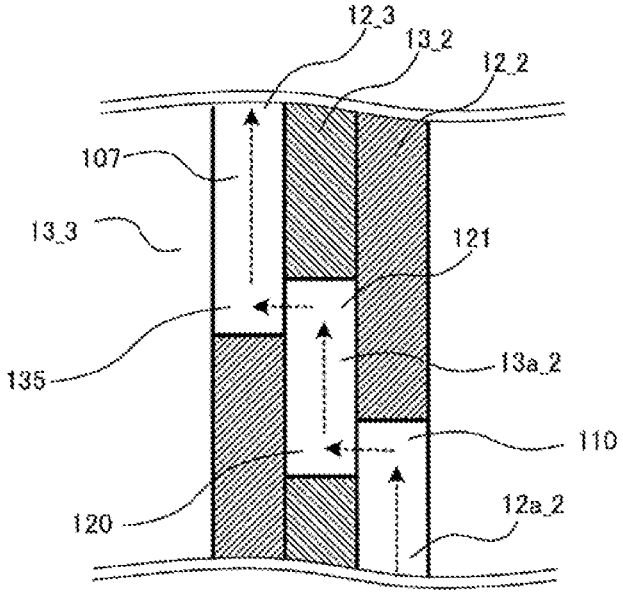
FIG. 13 is a schematic diagram for illustrating the refrigerant flow in the distributor according to Embodiment 2 of the present invention.

FIG. 12 is an exploded perspective view for illustrating the refrigerant flow in the first distributor 2A. FIG. 13 is a schematic diagram for illustrating the refrigerant flow in the first distributor 2A. Note that in FIG. 12 and FIG. 13, the refrigerant flow is represented by the dashed arrows.

Similarly to FIG. 7 and FIG. 8, FIG. 12 and FIG. 13 illustrate the branching portion 115, the end 110, the end 111, the bending portion 116, the branching portions 135, the ends 130, the ends 131, the ends 120, and the ends 121.

The first distributor 2A is different from the first distributor 2 according to Embodiment 1 in that the shape of the through holes 12*a*_3 provided in the first plate 12_3 is different from the shape of the through holes 12*a*_3 provided in the first plate 12_3 of the first distributor 2 according to Embodiment 1.

Specifically, the through holes 12*a*_3 each include an inflow path 107 communicating with an intermediate portion of the corresponding one of the branching portions 135 formed to pass through the first plate 12_3 in a Z-shape in a flow path cross section. That is, the branching portions 135 each serving as the branching flow path and the inflow paths 107 for allowing the refrigerant to flow into the corresponding one of the branching portions 135 are formed in the same plate (the first plate 12_3).

The inflow paths 107 each includes a fluid inlet end that is connected to the corresponding one of the ends 121 of the respective through holes 13*a*_2 each serving as an intermediate flow path, and a fluid outlet end that is connected to the corresponding one of the branching portions 135. Both of the ends of each of the inflow paths 107 are located not to overlap with each other, when the inflow paths 107 are viewed from the refrigerant flow direction. Thus, the inflow paths 107 are each formed to extend in the gravity direction. Specifically, as illustrated in FIG. 12, the inflow paths 107 are each formed in such a manner that the fluid inlet end and the fluid outlet end are arranged in the gravity direction. Note that the intermediate portion of each of the branching portions 135 is not necessarily the strictly center portion.

The ends 120 of the respective through holes 13*a*_2 are provided at positions each facing the corresponding one of the end 110 and the end 111 of the through hole 12*a*_2. The ends 121 of the respective through holes 13*a*_2 are provided at positions facing not the branching portions 135 of the respective through holes 12*a*_3 but the ends of each of the inflow paths 107.

Note that the through holes 13*a*_3 in the second plate 13_3 are provided at positions each facing the corresponding one of the ends 130 and the ends 131 of the through holes 12*a*_3.

Other configurations are the same as those of Embodiment 1.

<Flow of Refrigerant in First Distributor 2A>

Hereinafter, the flow of the refrigerant in the first distributor 2A will be described.

As illustrated in FIG. 12 and FIG. 13, the refrigerant having flowed into the first distributor 2A flows through the through hole 12*a*_1 and the through hole 13*a*_1, and then flows into the branching portion 115 of the through hole 12*a*_2 serving as the upstream branching flow path. The refrigerant having flowed into the branching portion 115 hits against the surface of the second plate 13_2 stacked adjacent to the first plate 12_2, and branches in two directions (left and right directions) to flow to the end 110 and the end 111 of the through hole 12*a*_2. The refrigerant having reached each of the end 110 and the end 111 of the through hole 12*a*_2 flows into the corresponding one of the ends 120 of the respective through holes 13*a*_2 in the second plate 13_2, the through holes 13*a*_2 each serving as the intermediate flow path.

The refrigerant having flowed into the ends 120 hits against the surface of the first plate 12_3 stacked adjacent to the second plate 13_2, and the liquid film is scattered. That is, the two-phase gas-liquid refrigerant collides with the planar surface (the surface of the first plate 12_3) facing the through holes 13*a*_2, and thereby the liquid film is scattered. Thereby, the liquid film of the refrigerant flowing through the through holes 13*a*_2 is prevented from concentrating, thereby is brought closer to the two-phase gas-liquid state in which the gas phase and the liquid phase are homogeneously mixed. The refrigerant having reached the ends 121 while maintaining this state flows into the fluid inlet end of each of the inflow paths 107 of the respective through holes 12*a*_3 each serving as the downstream branching flow path.

That is, as the through holes 13*a*_2 prevent the refrigerant from flowing straight from the through hole 12*a*_2 to the respective through holes 12*a*_3, the refrigerant state similar to that in the through hole 12*a*_2 serving as the upstream branching flow path can be also obtained each in the through holes 12*a*_3 each serving as the downstream branching flow path.

The refrigerant having flowed into the fluid inlet end of each of the inflow paths 107 hits against the surface of the second plate 13_3 stacked adjacent to the first plate 12_3, flows through the inflow path 107, reaches the fluid outlet end of the inflow path 107 (an end connected to the corresponding one of the branching portions 135), flows into the branching portion 135, and branches in two directions (left and right directions). The branched refrigerant flows to each of the ends 130 and 131. Ends 130 and the ends 131 of the respective through holes 12*a*_3 each serve as the fluid outlet, and the refrigerant having reached each of the ends 130 and the ends 131 of the respective through holes 12*a*_3 flows into the corresponding one of the heat transfer tubes 4 through tip portions 4*a* of the heat transfer tubes 4 each located in the corresponding one of the through holes 13*a*_3 or the through holes 12*a*_3.

Specifically, the refrigerant in the two-phase gas-liquid state that has flowed from each of the ends 121 of the respective through holes 13*a*_2 each serving as the connecting flow path flows into the corresponding one of the inflow paths 107 of the respective through holes 12*a*_3 located downstream. At this time, the refrigerant collides with the surface of the second plate 13-3 facing the through holes 13*a*_2. The two-phase gas-liquid refrigerant becomes in the more homogeneous state than the homogeneous state in each of the through holes 13*a*_2. Then, the refrigerant flows into the branching portions 135 of the respective through holes 13*a*_2, and branches at the branching portions 135.

<Function and Effect of First Distributor 2A and Heat Exchanger 1>

As described above, in the first distributor 2A, the inflow paths 107 are each provided to the through holes 12*a*_3 located downstream of the respective through holes 13*a*_2 each serving as the connecting flow path, in addition to the configuration of the first distributor 2 according to Embodiment 1. That is, in the first distributor 2A, a plurality of collision portions where the refrigerant collides with the plate are provided. Thereby, the gas phase and the liquid phase of the two-phase gas-liquid refrigerant can be more homogeneously mixed, and it becomes possible to adjust a distribution ratio of the refrigerant flow amount in each of the through holes 12*a*_3 to a predetermined amount (target value), for example, to branch the refrigerant flow at a ratio of 50%:50%. Thus, in the first distributor 2A, as the liquid film is prevented from concentrating at both of the upstream branching flow path and the downstream branching flow paths, the distribution ratio of the refrigerant flow amount can be adjusted to a predetermined amount (target value), and the excellent distribution performance can be achieved.

As the heat exchanger 1 includes the first distributor 2A, the refrigerant can flow into each path in the homogeneous state, to thereby improve the heat exchange efficiency.

Embodiment 3

A distributor according to Embodiment 3 of the present invention will be described.

In Embodiment 3, features different from those of Embodiments 1 and 2 will be mainly described, and the same reference signs are used for the same parts as those of Embodiments 1 and 2, and the description of the same parts is omitted.

Note that as a heat exchanger including the distributor according to Embodiment 3 is the same as the heat exchanger 1 described in Embodiment 1, the description of the heat exchanger is omitted. The distributor according to Embodiment 3 is referred to as a first distributor 2B.

<Configuration of Distributor According to Embodiment 3>

Hereinafter, a configuration of the first distributor 2B will be described. Here, the description will be made of an example in which the first distributor 2B is a stacking-type header. Note that the first distributor 2B may be an integrated-type header. In this case, the first distributor 2B is only required to be produced with reference to FIG. 9.

Figure 14:
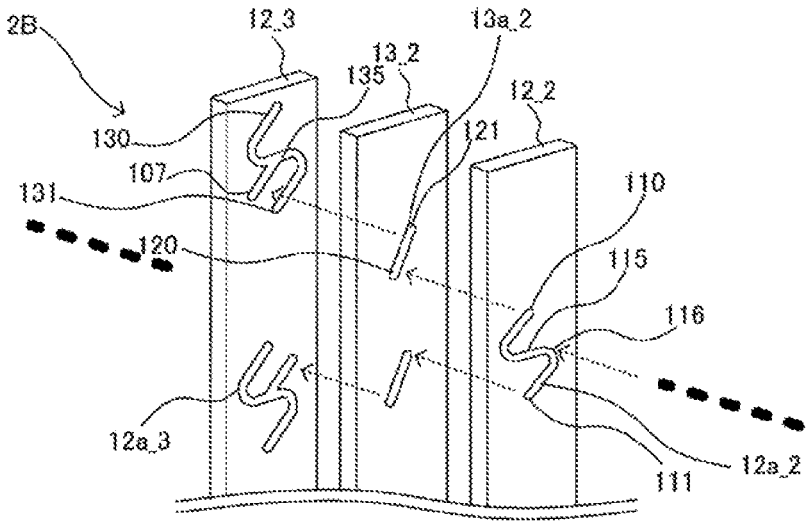
FIG. 14 is an exploded perspective view for illustrating a refrigerant flow in a distributor according to Embodiment 3 of the present invention.
Figure 15:
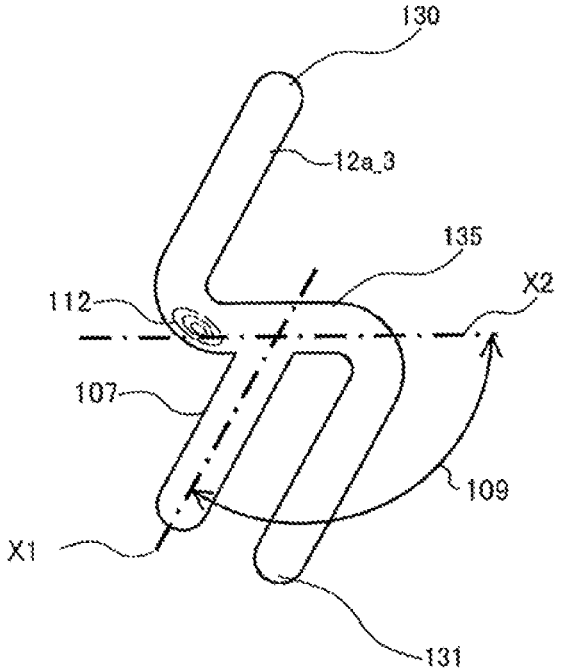
FIG. 15 is a schematic diagram for schematically illustrating a shape of a through hole provided in a first plate of the distributor according to Embodiment 3 of the present invention.

FIG. 14 is an exploded perspective view for illustrating the refrigerant flow in the first distributor 2B. FIG. 15 is a schematic diagram for schematically illustrating a shape of the through hole 12*a*_3 provided in the first plate 12_3 of the first distributor 2B. Note that in FIG. 14, the refrigerant flow is represented by the dashed arrows.

Similarly to FIG. 12 and FIG. 13, FIG. 14 and FIG. 15 illustrate the branching portion 115, the end 110, the end 111, the bending portion 116, the branching portions 135, the ends 130, the ends 131, the ends 120, the ends 121, and the inflow paths 107.

A basic shape of the first distributor 2B is the same as that of the first distributor 2A according to Embodiment 2, but is different from the first distributor 2A according to Embodiment 2 in that the shape of the through holes 12*a*_3 provided in the first plate 12_3 is different from the shape of the through holes 12*a*_3 provided in the first plate 12_3 of the first distributor 2A according to Embodiment 2.

That is, the first distributor 2B is different from the first distributor 2A according to Embodiment 2 in that the inflow paths 107 are each inclined to the gravity direction.

Specifically, in the first distributor 2B, the branching portions 135 and the inflow paths 107 are provided in the first plate 12_3, and one end of each of the inflow paths 107 (a fluid inlet end) and the other end of each of the inflow paths 107 (a fluid outlet end) are located at positions different from each other across the gravity direction. Furthermore, the refrigerant flow direction (a line X1 shown in FIG. 15) in each of the inflow paths 107 is not perpendicular to the refrigerant flow direction (a line X2 shown in FIG. 15) in the fluid portion of each of the branching portions 135 in the respective through holes 12*a*_3, and the line X1 and the line X2 meet at a predetermined inflow angle 109.

Other configurations are the same as those of Embodiments 1 and 2.

<Flow of Refrigerant in First Distributor 2B>

Hereinafter, the flow of the refrigerant in the first distributor 2B will be described.

As illustrated in FIG. 14 and FIG. 15, the refrigerant having flowed into the first distributor 2B flows through the through hole 12*a*_1 and the through hole 13*a*_1, and then flows into the branching portion 115 of the through hole 12*a*_2 serving as the upstream branching flow path. The refrigerant having flowed into the branching portion 115 hits against the surface of the second plate 13_2 stacked adjacent to the first plate 12_2, and branches in two directions (left and right directions) to flow to the end 110 and the end 111 of the through hole 12*a*_2. The refrigerant having reached each of the end 110 and the end 111 of the through hole 12*a*_2 flows into the corresponding one of the ends 120 of the respective through holes 13*a*_2 in the second plate 13_2, the through holes 13*a*_2 each serving as the intermediate flow path.

The refrigerant having flowed into the ends 120 hits against the surface of the first plate 12_3 stacked adjacent to the second plate 13_2, and the liquid film is scattered. That is, the two-phase gas-liquid refrigerant collides with the planar surface (the surface of the first plate 12_3) facing the through holes 13*a*_2, and thereby the liquid film is scattered. Thereby, the liquid film of the refrigerant flowing through the through holes 13*a*_2 is prevented from concentrating, thereby is brought closer to the two-phase gas-liquid state in which the gas phase and the liquid phase are homogeneously mixed. The refrigerant having reached the ends 121 while maintaining this state flows into the fluid inlet end of each of the inflow paths 107 of the respective through holes 12*a*_3 each serving as the downstream branching flow path.

That is, as the through holes 13*a*_2 prevent the refrigerant from flowing straight from the through hole 12*a*_2 to the respective through holes 12*a*_3, the refrigerant state similar to that in the through hole 12*a*_2 serving as the upstream branching flow path can be also obtained each in the through holes 12*a*_3 each serving as the downstream branching flow path.

The refrigerant having flowed into the fluid inlet end of each of the inflow paths 107 hits against the surface of the second plate 13_3 stacked adjacent to the first plate 12_3, flows through the inflow path 107, reaches the other end of the inflow path 107 (an end connected to the corresponding one of the branching portions 135), flows into the branching portion 135, and branches in two directions (left and right directions). The branched refrigerant flows to each of the ends 130 and 131. Ends 130 and the ends 131 of the respective through holes 12*a*_3 each serve as the fluid outlet, and the refrigerant having reached each of the ends 130 and the ends 131 of the respective through holes 12*a*_3 flows into the corresponding one of the heat transfer tubes 4 through tip portions 4*a* of the heat transfer tubes 4 each located in the corresponding one of the through holes 13*a*_3 or the through holes 12*a*_3.

Specifically, the refrigerant in the two-phase gas-liquid state that has flowed from the ends 121 of the respective through holes 13*a*_2 each serving as the connecting flow path flows into the corresponding one of the inflow paths 107 of the respective through holes 12*a*_3 located downstream. At this time, the refrigerant collides with the surface of the second plate 13-3 facing the through holes 13*a*_2. The two-phase gas-liquid refrigerant becomes in the more homogeneous state than the homogeneous state in each of the through holes 13*a*_2. Then, the refrigerant flows into the branching portions 135 of the respective through holes 13*a*_2, and branches at the branching portions 135.

At this time, the refrigerant flowing through the inflow paths 107 flows into the respective branching portions 135 at the inflow angle 109. Consequently, the refrigerant concentratedly flows into the ends 131 of the respective through holes 12*a*_3 by a large amount because of an inertial force. In addition, as a vortex 112 is generated in a bending portion of each of the branching portions 135, the respective flow path portions in which the refrigerant flows each narrow. Both effects causes increase in the flow amount of the refrigerant flowing into the ends 131. The proportion between the flow amount of the refrigerant flowing into each of the ends 130 of the respective branching portions 135 and the flow amount of each of the refrigerant flowing into the ends 131 of the respective branching portions 135 has a linear relationship to the positional relationship (inflow angle) between each set of the inflow paths 107 and the branching portions 135, and the proportion can be controlled by the positional relation between each set. This can be achieved by providing the homogeneous gas-liquid phase state of the refrigerant before the refrigerant reaches the branching portions 135.

<Function and Effect of First Distributor 2B and Heat Exchanger 1>

As described above, in the first distributor 2B, the inflow paths 107 are each provided to be inclined to the gravity direction, in addition to the configuration of the first distributor 2A according to Embodiment 2. That is, in the first distributor 2B, a plurality of collision portions where the refrigerant collides with the plate are provided, and the distribution ratio can be adjusted. Thereby, the gas phase and the liquid phase of the two-phase gas-liquid refrigerant can be more homogeneously mixed, and it becomes possible to adjust the distribution ratio of the refrigerant flow amount in each of the through holes 12*a*_3 to a predetermined amount (target value). Thus, in the first distributor 2B, as the liquid film is prevented from concentrating at both of the upstream branching flow path and the downstream branching flow paths, the distribution ratio of the refrigerant flow amount can be adjusted to a predetermined amount (target value), and the excellent distribution performance can be achieved.

As the heat exchanger 1 includes the first distributor 2B, the refrigerant can flow into each path in the homogeneous state, to thereby improve the heat exchange efficiency.

Embodiment 4

A refrigeration cycle apparatus according to Embodiment 4 of the present invention will be described.

<Configuration of Refrigeration Cycle Apparatus 100>

Hereinafter, a schematic configuration of the refrigeration cycle apparatus 100 according to Embodiment 4 will be described.

Figure 16:
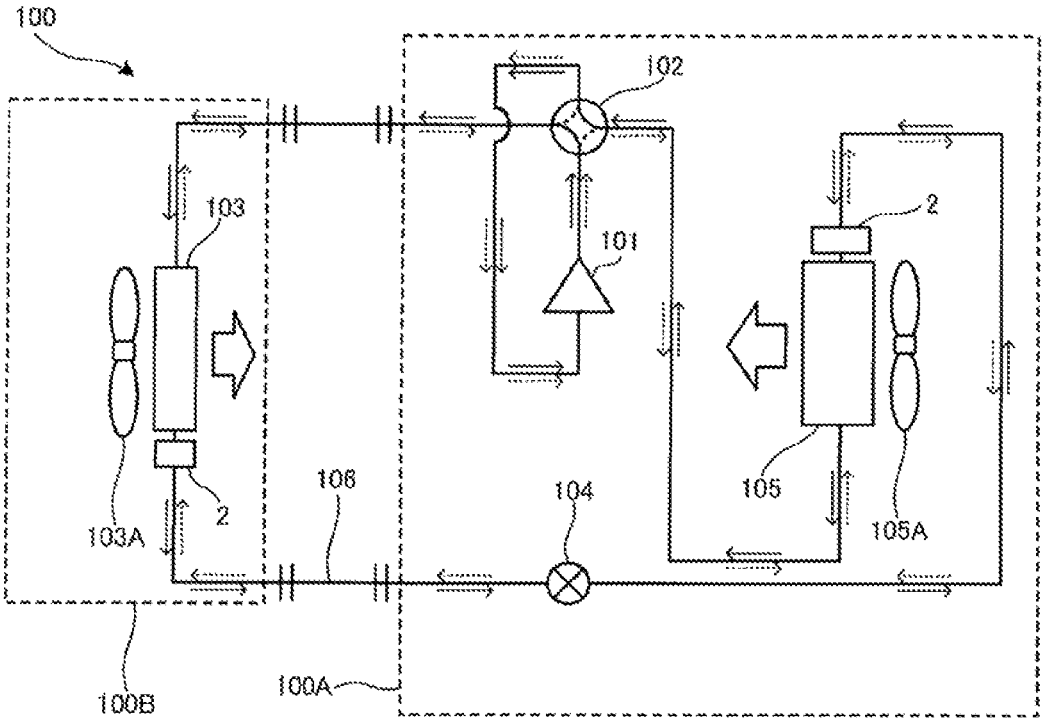
FIG. 16 is a circuit configuration diagram schematically illustrating an exemplary configuration of a refrigerant circuit of a refrigeration cycle apparatus according to Embodiment 4 of the present invention.

FIG. 16 is a circuit configuration diagram schematically illustrating an exemplary configuration of a refrigerant circuit of the refrigeration cycle apparatus 100 according to Embodiment 4. In Embodiment 4, features different from those of Embodiments 1 to 3 will be mainly described, and the same reference signs are used for the same parts as those of Embodiments 1 to 3, and the description of the same parts is omitted. In FIG. 16, the refrigerant flow during the cooling operation is represented by the dashed arrows, the refrigerant flow during the heating operation is represented by the solid arrows, and the air flow is represented by the outlined arrows.

The refrigeration cycle apparatus 100 includes a heat exchanger provided with the distributor according to any one of Embodiments 1 to 3, as one component. For the convenience of the description, the description will be made of a case in which the refrigeration cycle apparatus 100 includes the heat exchanger 1 provided with the first distributor 2 according to Embodiment 1. In Embodiment 4, description will be made of an example in which the refrigeration cycle apparatus 100 is an air-conditioning apparatus.

The refrigeration cycle apparatus 100 includes a first unit 100A and a second unit 1008. The first unit 100A is used as a heat source unit, an outdoor unit, or other units. The second unit 100B is used as an indoor unit, a use side unit (a load side unit), or other units.

The first unit 100A accommodates a compressor 101, a flow switching device 102, an expansion device 104, a second heat exchanger 105, and a fan 105A provided with the second heat exchanger 105. The second heat exchanger 105 is provided with the first distributor 2. That is, as the second heat exchanger 105, the heat exchanger 1 described in Embodiment 1 is applied.

The second unit 1008 accommodates a first heat exchanger 103, and a fan 103A provided with the first heat exchanger 103. The first heat exchanger 103 is provided with the first distributor 2. That is, as the first heat exchanger 103, the heat exchanger 1 described in Embodiment 1 is applied.

As illustrated in FIG. 16, the compressor 101, the first heat exchanger 103, the expansion device 104, and the second heat exchanger 105 are connected to each other with a refrigerant pipe 106, to form a refrigerant circuit. The fan 103A is provided with the first heat exchanger 103 to supply the air to the first heat exchanger 103. The fan 105A is provided with the second heat exchanger 105 to supply the air to the second heat exchanger 105.

The compressor 101 is configured to compress refrigerant. The refrigerant compressed by the compressor 101 is discharged to the first heat exchanger 103 or the second heat exchanger 105. The compressor 101 is, for example, a rotary compressor, a scroll compressor, a screw compressor, or a reciprocating compressor.

The flow switching device 102 is configured to switch the refrigerant flows between the heating operation and the cooling operation. That is, during the heating operation, the flow switching device 102 is configured to switch the flow of the refrigerant to the flow that connects the compressor 101 to the first heat exchanger 103. In contrast, during the cooling operation, the flow switching device 102 is configured to switch the flow of the refrigerant to the flow that connects the compressor 101 to the second heat exchanger 105. The flow switching device 102 is preferably, for example, a four-way valve. Alternatively, the flow switching device 102 may be a combination of two-way valves or three-way valves.

The first heat exchanger 103 serves as a condenser during the heating operation, and serves as an evaporator during the cooling operation. That is, the first heat exchanger 103 serving as a condenser causes heat exchange between high-temperature and high-pressure refrigerant discharged from the compressor 101 and the air supplied from the fan 103A, resulting in condensation of the high-temperature and high-pressure gas refrigerant. In contrast, the first heat exchanger 103 serving as an evaporator causes heat exchange between low-temperature and low-pressure refrigerant flowing from the expansion device 104 and the air supplied from the fan 103A, resulting in evaporation of the low-temperature and low-pressure liquid refrigerant or two-phase refrigerant.

The expansion device 104 is configured to expand and decompress the refrigerant flowing from the first heat exchanger 103 or the second heat exchanger 105. The expansion device 104 is preferably, for example, an electric expansion valve that can adjust the flow rate of refrigerant. Alternatively, the expansion device 104 may be, for example, a capillary tube or a mechanical expansion valve including a diaphragm in a pressure sensing portion, other than the electric expansion valve.

The second heat exchanger 105 serves as an evaporator during the heating operation, and serves as a condenser during the cooling operation. That is, the second heat exchanger 105 serving as an evaporator causes heat exchange between low-temperature and low-pressure refrigerant flowing from the expansion device 104 and the air supplied from the fan 105A, resulting in evaporation of the low-temperature and low-pressure liquid refrigerant or two-phase refrigerant. In contrast, the second heat exchanger 105 serving as a condenser causes heat exchange between high-temperature and high-pressure refrigerant discharged from the compressor 101 and the air supplied from the fan 105A, resulting in condensation of the high-temperature and high-pressure gas refrigerant.

<Operations of Refrigeration Cycle Apparatus 100>

Hereinafter, the operations of the refrigeration cycle apparatus 100 and the refrigerant flow will be described. The operations of the refrigeration cycle apparatus 100 are described, as an example, in a case in which the fluid that performs heat exchange is air and the fluid that is subjected to heat exchange is refrigerant.

First, the cooling operation executed by the refrigeration cycle apparatus 100 will be described. The refrigerant flow during the cooling operation is represented by the dashed arrows in FIG. 16.

As illustrated in FIG. 16, the compressor 101 is driven and thus discharges high-temperature and high-pressure gas refrigerant. The refrigerant then flows to follow the dashed arrows. The high-temperature and high-pressure gas refrigerant (single phase) discharged from the compressor 101 flows through the flow switching device 102 into the second heat exchanger 105 serving as a condenser. The second heat exchanger 105 causes heat exchange between this high-temperature and high-pressure gas refrigerant having flowed into the second heat exchanger 105 and air supplied from the fan 105A, so that the high-temperature and high-pressure gas refrigerant condenses into high-pressure liquid refrigerant (single phase).

The high-pressure liquid refrigerant output from the second heat exchanger 105 is converted into two-phase refrigerant containing low-pressure gas refrigerant and low-pressure liquid refrigerant by the expansion device 104. This two-phase refrigerant flows into the first heat exchanger 103 serving as an evaporator. The first heat exchanger 103 is provided with the first distributor 2, so that the refrigerant is distributed by the first distributor 2 by the number of paths in the first heat exchanger 103, and flows into the heat transfer tubes 4 included in the first heat exchanger 103.

The first heat exchanger 103 causes heat exchange between the two-phase refrigerant having flowed into the first heat exchanger 103 and air supplied from the fan 103A, so that the liquid refrigerant contained in the two-phase refrigerant evaporates, resulting in low-pressure gas refrigerant (single phase). The low-pressure gas refrigerant output from the first heat exchanger 103 flows through the flow switching device 102 into the compressor 101. The compressor 101 compresses this low-pressure gas refrigerant into high-temperature and high-pressure gas refrigerant and discharges the resulting gas refrigerant again. This operation will be repeated.

Next, the heating operation executed by the refrigeration cycle apparatus 100 will be described. The refrigerant flow during the heating operation is represented by the solid arrows in FIG. 16.

As illustrated in FIG. 16, the compressor 101 is driven and thus discharges high-temperature and high-pressure gas refrigerant. The refrigerant then flows to follow the solid arrows. The high-temperature and high-pressure gas refrigerant (single phase) discharged from the compressor 101 flows through the flow switching device 102 into the first heat exchanger 103 serving as a condenser. The first heat exchanger 103 causes heat exchange between this high-temperature and high-pressure gas refrigerant having flowed into the first heat exchanger 103 and air supplied from the fan 103A, so that the high-temperature and high-pressure gas refrigerant condenses into high-pressure liquid refrigerant (single phase).

The high-pressure liquid refrigerant output from the first heat exchanger 103 is converted into two-phase refrigerant containing low-pressure gas refrigerant and low-pressure liquid refrigerant by the expansion device 104. This two-phase refrigerant flows into the second heat exchanger 105 serving as an evaporator. The second heat exchanger 105 is provided with the first distributor 2, so that the refrigerant is distributed by the first distributor 2 by the number of paths in the second heat exchanger 105, and flows into the heat transfer tubes 4 included in the second heat exchanger 105.

The second heat exchanger 105 causes heat exchange between the two-phase refrigerant having flowed into the second heat exchanger 105 and air supplied from the fan 105A, so that the liquid refrigerant contained in the two-phase refrigerant evaporates, resulting in low-pressure gas refrigerant (single phase). The low-pressure gas refrigerant output from the second heat exchanger 105 flows through the flow switching device 102 into the compressor 101. The compressor 101 compresses this low-pressure gas refrigerant into high-temperature and high-pressure gas refrigerant and discharges the resulting gas refrigerant again. This operation will be repeated.

As described above, the refrigeration cycle apparatus 100 includes the first distributor 2 located upstream part of each of the first heat exchanger 103 and the second heat exchanger 105.

Consequently, in the refrigeration cycle apparatus 100, as the refrigerant can flow into each path in the first heat exchanger 103 and the second heat exchanger 105 in a homogeneous state, the performance of the heat exchangers can be improved to thereby maximize the heat exchange efficiency.

The description is made of an example in which the heat exchanger according to any one of Embodiments 1 to 3 is provided as each of the first heat exchanger 103 and the second heat exchanger 105. Alternatively, the heat exchanger according to any one of Embodiments 1 to 3 may be provided as at least one of the first heat exchanger 103 and the second heat exchanger 105.

The refrigerant used in the refrigeration cycle apparatus 100 is not limited to a particular refrigerant. Other types of refrigerant, such as R410A, R32, and HFO1234yf, may also be used to bring about the same effects.

Although the working fluids are air and refrigerant as examples, the working fluids are not limited to air and refrigerant. The working fluids may be replaced with another gas, liquid, or gas-liquid mixed fluid to bring about the same effects. In other words, the working fluids may be changed and any working fluid leads to the same effects.

Other examples of the refrigeration cycle apparatus 100 include a water heater, a freezer, and an air-conditioning water heater. Any of these apparatuses can obtain the performance of the heat exchanger at the maximum, thereby improving the heat exchange efficiency.

The invention claimed is:

1. A distributor for distributing fluid to a plurality of fluid outlets, the fluid flowing from a fluid inlet, the distributor comprising:

a plurality of branching flow paths having an upstream branching flow path, and downstream branching flow paths located closer to the plurality of fluid outlets than is the upstream branching flow path, the upstream branching flow path having ends, the downstream branching flow paths each having a center; and an intermediate flow path provided between the upstream branching flow path and at least one of the downstream branching flow paths, the intermediate flow path connecting the upstream branching flow path and the at least one of the downstream branching flow paths, the upstream branching flow path, the intermediate flow path, and the at least one of the downstream branching flow paths are each provided respectively on individual stacked plates, the distributor being formed in such a manner that the fluid flows in a direction from the fluid inlet to the plurality of branching flow paths, the intermediate flow path having one end directly connected to one of the ends of the upstream branching flow path and an other end directly connected to the center of the at least one of the downstream branching flow paths, the intermediate flow path causing the fluid flowing from the one end to change a flow direction of the fluid into a direction orthogonal to a stacking direction of the stacked plates and then flow from the one end to out of the other end without the fluid being branched in the intermediate flow path.

2. The distributor of claim 1, wherein the intermediate flow path is formed in such a manner that a flow path length of a portion connecting the one end and the other end is at least two times greater than a flow path width of a portion perpendicular to the portion connecting the one end and the other end.

3. The distributor of claim 1, wherein the downstream branching flow paths each include a branching portion for branching the fluid in two directions, and an inflow path communicating with an intermediate portion of the branching portion, and the inflow path includes a fluid inlet end connecting the other end of the intermediate flow path, and a fluid outlet end connecting the branching portion, and the inflow path causes the fluid flowing from the fluid inlet end to change a flow direction of the fluid and then flow out of the other end.

4. The distributor of claim 3, wherein the inflow path is formed in such a manner that the fluid inlet end and the fluid outlet end are arranged in a gravity direction.

5. The distributor of claim 3, wherein the inflow path is formed in such a manner that the fluid inlet end and the fluid outlet end are located at positions different from each other across a gravity direction.

6. The distributor of claim 5, wherein the inflow path is formed in such a manner that a flow direction of the fluid flowing from the fluid inlet end to the fluid outlet end is not perpendicular to a flow direction of the fluid flowing through a portion of the branching portion that connects the fluid outlet end.

7. The distributor of claim 1, wherein the fluid inlet, the plurality of branching flow paths, and the plurality of fluid outlets are formed in such a manner that the plates each having a through hole are stacked.

8. A heat exchanger, comprising:

the distributor of claim 1; and a plurality of heat transfer tubes into which the fluid flowing out of the plurality of fluid outlets of the distributor flows.

9. The heat exchanger of claim 8, wherein the plurality of heat transfer tubes are each a circular tube or a flat tube.

10. A refrigeration cycle apparatus, comprising the heat exchanger of claim 8 serving as at least one of an evaporator and a condenser.

* * * * *